US008701609B2

(12) United States Patent
Wahl et al.

(10) Patent No.: US 8,701,609 B2
(45) Date of Patent: Apr. 22, 2014

(54) CAMSHAFT HAVING A SLIDING PIECE WHICH HAS DIFFERENT CAM PROFILES

(75) Inventors: Michael Wahl, Sachsenheim (DE); Siegfried Luhmann, Oedheim (DE); Rainer Messer, Öhringen-Unterohrn (DE)

(73) Assignee: Dr. Ing. h.c. F. Porsche Aktiengesellschaft, Stuttgart (DE)

( * ) Notice: Subject to any disclaimer, the term of this patent is extended or adjusted under 35 U.S.C. 154(b) by 75 days.

(21) Appl. No.: 13/442,258

(22) Filed: Apr. 9, 2012

(65) Prior Publication Data

US 2012/0260870 A1 Oct. 18, 2012

(30) Foreign Application Priority Data

Apr. 18, 2011 (DE) ..... 10 2011 002 141

(51) Int. Cl.
*F01L 1/34* (2006.01)

(52) U.S. Cl.
USPC ..... 123/90.16; 123/90.6

(58) Field of Classification Search
CPC ..... F01L 1/3442
USPC ..... 123/90.6, 90.16, 90.52, 90.43, 90.24
See application file for complete search history.

(56) References Cited

U.S. PATENT DOCUMENTS

| | | | | |
|---|---|---|---|---|
| 7,000,581 | B1 * | 2/2006 | Mavinahally et al. | 123/90.24 |
| 2005/0011480 | A1 * | 1/2005 | Schultz et al. | 123/90.16 |
| 2010/0288217 | A1 | 11/2010 | Stolk et al. | |

FOREIGN PATENT DOCUMENTS

| | | | |
|---|---|---|---|
| DE | 102008005639 | A1 | 7/2009 |

* cited by examiner

*Primary Examiner* — Zelalem Eshete
(74) *Attorney, Agent, or Firm* — RatnerPrestia

(57) ABSTRACT

A camshaft assembly has a rotationally drivable basic camshaft and at least one sliding piece which is mounted in the basic camshaft and can be displaced in the longitudinal direction of the latter, the sliding piece having at least one cam pack with at least two cams with different cam profiles, and having a switching device which has a switch guide plate for displacing the at least one sliding piece into different switching positions of the cams. It is provided in a camshaft of this type that the switching device has a switching shaft which can be rotated about the rotational axis of the basic camshaft with a switch guide plate which has a slotted-guide track, and a slotted-guide pin which is connected to the sliding piece and engages into the slotted-guide track.

14 Claims, 6 Drawing Sheets

CAMSHAFT HAVING A SLIDING PIECE WHICH HAS DIFFERENT CAM PROFILES

CROSS-REFERENCE TO RELATED APPLICATION

Figure 1:
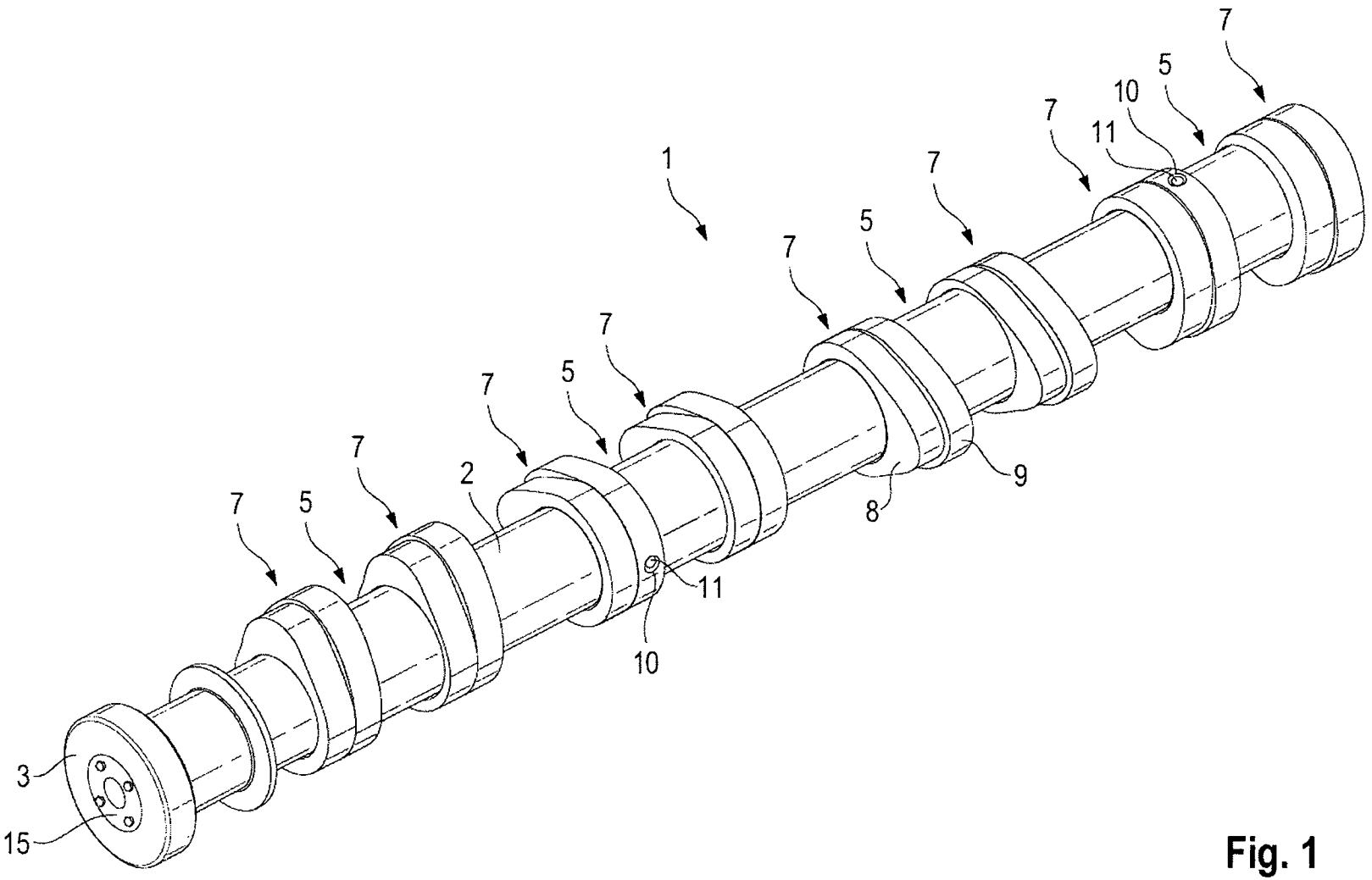

This U.S. patent application claims priority to German Patent Application DE 10 2011 002 141.8, filed Apr. 18, 2011, which is incorporated by reference herein in its entirety.

FIELD OF THE INVENTION

The invention relates to a camshaft having a rotationally drivable basic camshaft and at least one sliding piece which is mounted in the basic camshaft and can be displaced in the longitudinal direction of the latter, the sliding piece having at least one cam pack with at least two cams with different cam profiles, and having a switching device for displacing the at least one sliding piece into different switching positions of the cam profiles.

BACKGROUND OF THE INVENTION

A camshaft of this type is used in a cylinder head of an internal combustion engine. Each valve—inlet and outlet valve—for bringing about the gas exchange is assigned a cam pack which has a plurality of, for example two or three, cams with different cam profiles. The cam profiles have the same base circle radius, the cams being of different configuration in each case for different operating modes, such as a firing mode and an engine braking mode, and a low rotational speed range and a high rotational speed range. Depending on the operating mode, a cam of the cam pack is brought into operative connection with the gas exchange valve which is assigned to said cam pack, by displacement of the sliding piece.

A camshaft of the type mentioned in the introduction is known from DE 10 2008 005 639 A1, which is incorporated by reference herein in its entirety. A camshaft having two sliding pieces which can be displaced in its basic camshaft is described there. Each of the sliding pieces has a plurality of cam packs, each cam pack having two cams with different cam profiles. An actuating device serves to displace the sliding pieces from a first switching position into a second switching position or vice versa. The displacement in the axial direction of the sliding pieces is defined by a switching path of a switch guide plate having two slotted-guide tracks. The switching path corresponds to the mean spacing of the two cams of a cam pair. The actuating device has two actuating pins which can engage into the slotted-guide tracks of the switch guide plate, as a result of which the sliding pieces are displaced axially by means of the rotation of the basic camshaft. Starting from the first switching position, first of all one sliding piece is displaced into the second switching position. After displacement of this sliding piece, the other sliding piece is displaced from the first into the second switching position. In this guide plate, the switch guide plate is arranged next to the sliding piece, in relation to the axial extent of the camshaft. The camshaft therefore has a relatively great axial length.

SUMMARY OF THE INVENTION

Disclosed herein is a camshaft of the type mentioned in the introduction that switches to and fro of the sliding piece which has the different cam profiles, with a structurally simple, compact design and low number of parts for the camshaft.

The switching device has a switching shaft which can be rotated about the rotational axis of the basic camshaft with a switch guide plate which has a slotted-guide track, and a slotted-guide pin which is connected to the sliding piece and engages into the slotted-guide track, the slotted-guide track being endless and switching to and fro of the sliding piece taking place in the same rotational direction of the switching shaft.

The camshaft therefore requires only one slotted-guide track in the switch guide plate of the switching shaft per sliding piece, and the slotted-guide pin which is connected to the sliding piece engages into said slotted-guide track. Since the slotted-guide track is endless, switching to and fro of the sliding piece can take place in the same rotational direction of the switching shaft. If, starting from an initial angular position, the switching shaft is rotated by a defined angle, this leads to a displacement of the sliding piece from an initial position into a new position, whereby forward switching is brought about. During the further rotation of the switching shaft by a defined angle, the sliding piece remains in this position. If the switching shaft is rotated even further by a defined angle, the slotted-guide track brings about an opposed movement of the sliding piece relative to the basic camshaft in the sense of backward switching, and the sliding piece remains in this position during the further rotation of the switching shaft by a defined angle. When a complete revolution, that is to say a rotation of the switching shaft by 360°, has taken place, the described sequence with switching to and fro of the sliding piece starts again.

The switching device has a switching shaft which can be rotated about the rotational axis of the basic camshaft with a switch guide plate which has a slotted-guide track, and a slotted-guide pin which is connected to the sliding piece and engages into the slotted-guide track, the switching shaft being arranged within the basic camshaft, and the basic camshaft having an opening in its wall, which opening the slotted-guide pin penetrates.

The basic camshaft therefore surrounds the switching shaft. This design makes a simple construction possible, since the outer basic camshaft receives the at least one sliding piece which can be displaced in its longitudinal direction, and the displacement of the sliding piece can take place by way of the switching shaft which is arranged centrally, and therefore within the basic camshaft. In this design, the basic camshaft has an opening in its wall, which opening the slotted-guide pin penetrates. During shifting to and fro of the sliding piece, the sliding piece and therefore the slotted-guide pin move exclusively in the axial direction of the basic camshaft, with the result that said opening is preferably formed as a slot which extends in the axial direction of the basic camshaft.

According to one development of the first design the switching shaft is arranged within the basic camshaft, and the basic camshaft has an opening in its wall, which opening the slotted-guide pin penetrates. According to one development of the second solution, the slotted-guide track is endless and shifting to and fro of the sliding piece takes place in the same rotational direction of the switching shaft.

The camshaft can be used for single-cylinder and multiple-cylinder engines. The camshaft preferably has one sliding piece for each cylinder which is assigned to said camshaft. In particular, the respective sliding piece has two cam packs for two inlet valves or two outlet valves of the respective cylinder. The respective cam pack has, in particular, two or three cams with different cam profiles. The cams of the respective cam pack are designed, in particular, in such a way that they have a different cam profile in relation to their contour and/or lift.

A structurally particularly simple design and mounting of the respective sliding piece in the basic camshaft results if the basic camshaft has a spline tooth system on the external diameter in the region of the respective sliding piece, and the sliding piece has a corresponding spline tooth system on the internal diameter. On account of the spline tooth systems, the sliding piece can be displaced axially on the basic camshaft, but cannot rotate relative to the basic camshaft.

It is considered to be advantageous if the switching shaft has an end-side receptacle for an adjusting unit for rotating the switching shaft. As the result of a pulse which is triggered by the controller of the internal combustion engine, the adjusting mechanism or the actuator system rotates the switching shaft during the base circle phase of the respective cam or cam pack with or counter to the rotational direction of the basic camshaft by a defined angle and therefore triggers the switching operation, by way of which the sliding piece is moved relative to the basic camshaft in its axial direction.

The respective slotted-guide track, via which the axial displacement of the sliding piece is brought about in interaction with the slotted-guide pin, is designed in such a way that it has two substantially parallel first slotted-guide sections which are positioned substantially in planes which are arranged perpendicularly with respect to the rotational axis of the switching shaft, and two second slotted-guide sections which connect said slotted-guide sections and bring about the switching. As a result of these four slotted-guide sections, switching to and fro of the sliding piece and therefore of the cams of the cam pack is possible with a structurally very simple design.

One second slotted-guide section is preferably assigned to a relative rotary angle range of the switching shaft of from 0° to 45° and the other second slotted-guide section is assigned to a relative rotary angle range of the switching shaft of from 180° to 225°. Here, the designation of the relative rotary angle range is selected because, in multiple-cylinder engines, for example a four-cylinder engine, it goes without saying that one second slotted-guide section and the other second slotted-guide section of one cylinder are assigned to different angles than other cylinders, the rotary angle range of from 0° to 45° and from 180° to 225° nevertheless being assigned in the respective other cylinder, in relation to another initial angle of the switching shaft. The result for engines with a different number of cylinders is other switching angles, for example 90° relative rotary angle range in the case of a two-cylinder engine and 60° relative rotary angle range in the case of a three-cylinder engine, etc.

In particular, in the case of a camshaft for a four-cylinder inline engine, the slotted-guide tracks of the switch guide plates of the sliding pieces are arranged in a relatively rotated manner with regard to the switching shaft, such that the displacement of the four sliding pieces takes place in the ignition sequence cylinder 1-cylinder 3-cylinder 4-cylinder 2. A different ignition sequence is possible, for example cylinder 1-cylinder 2-cylinder 3-cylinder 4.

The invention therefore proposes a camshaft, with which switching to and fro is possible by way of the same slotted-guide track of the respective switch guide plate. The respective switch guide plate is situated in the interior of the camshaft. Cylinder-selective switching in the ignition sequence is possible by way of a defined arrangement of the slotted-guide sections of the respective slotted-guide track. During the switching operation, the switching shaft is rotated only in one direction relative to the basic camshaft. Endless switching is possible as a result of the design of the respective switch guide plate, that is to say the switching shaft is always rotated in one direction, the switching direction, independently of whether switching to or fro is to take place. Depending on the configuration of the slotted-guide track, the starting and end points of the switching operation can vary, in relation to the position of the basic camshaft. The camshaft according to aspects of the invention can be used for single-cylinder and multiple-cylinder engines. The camshaft can be mounted via sliding pieces or via bearing points between the sliding pieces.

BRIEF DESCRIPTION OF THE DRAWING FIGURES

Figure 2:
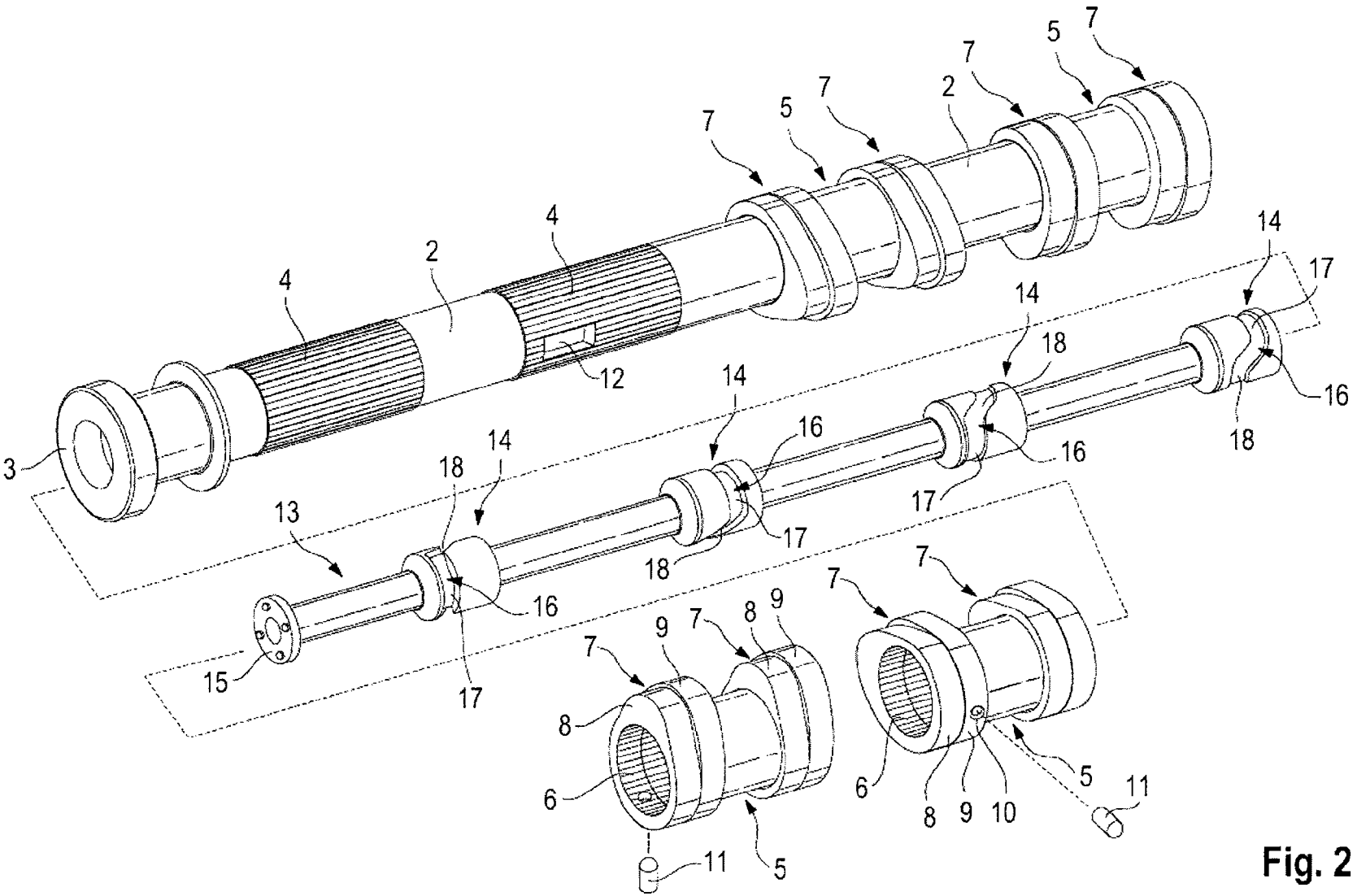
Figure 3:
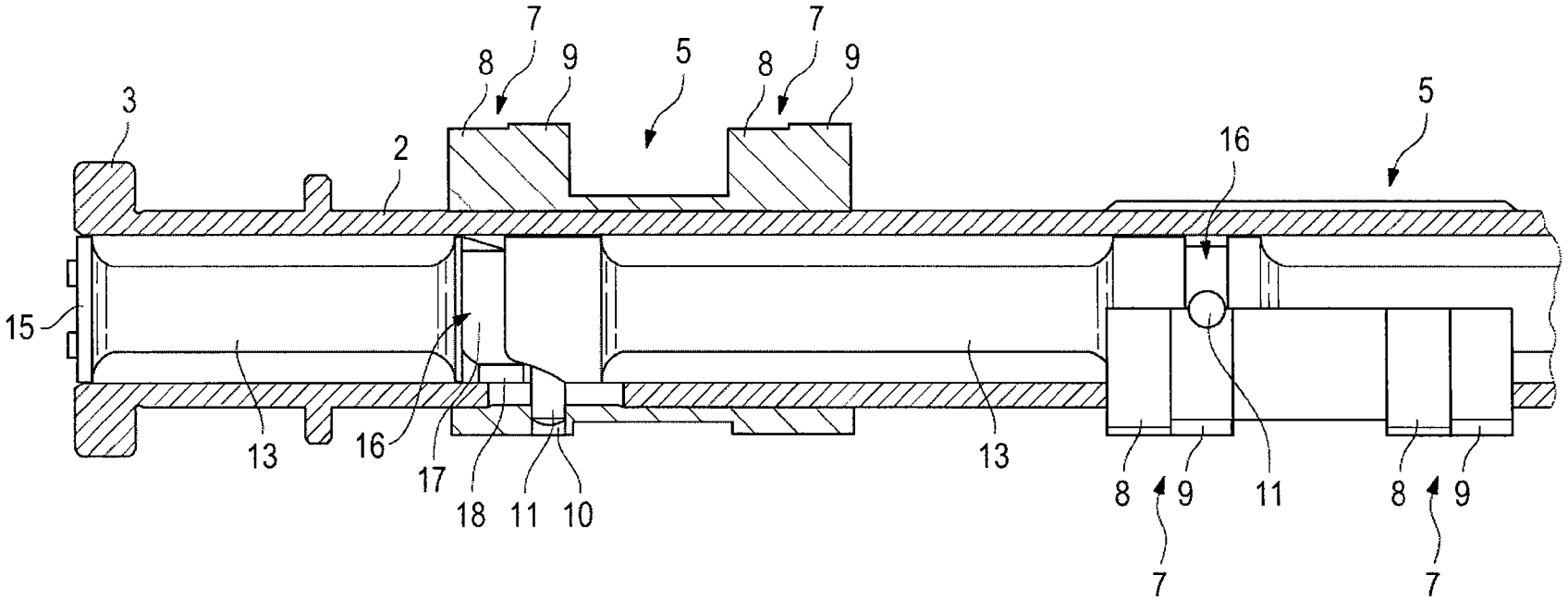
Figure 4:
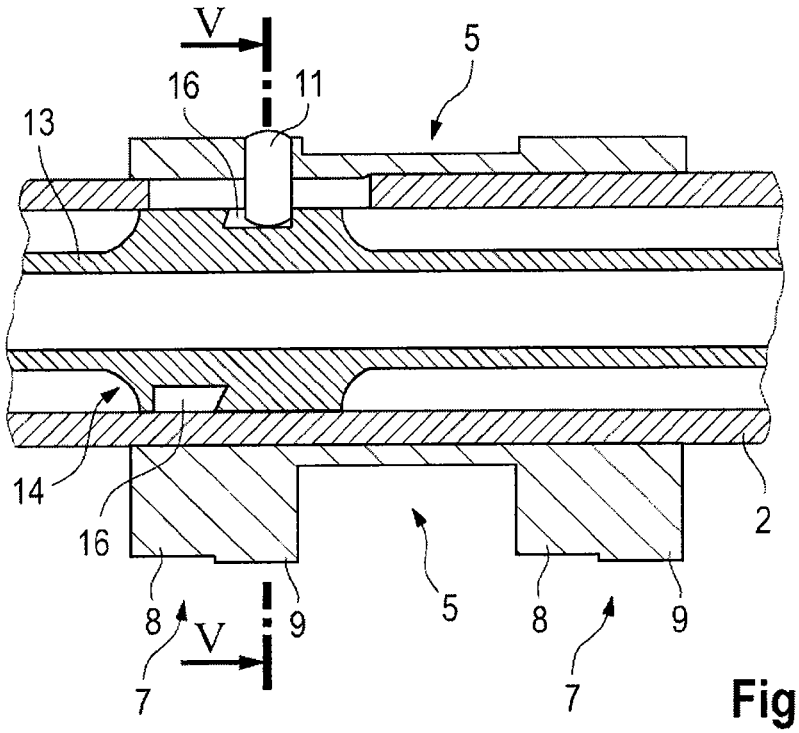
Figure 5:
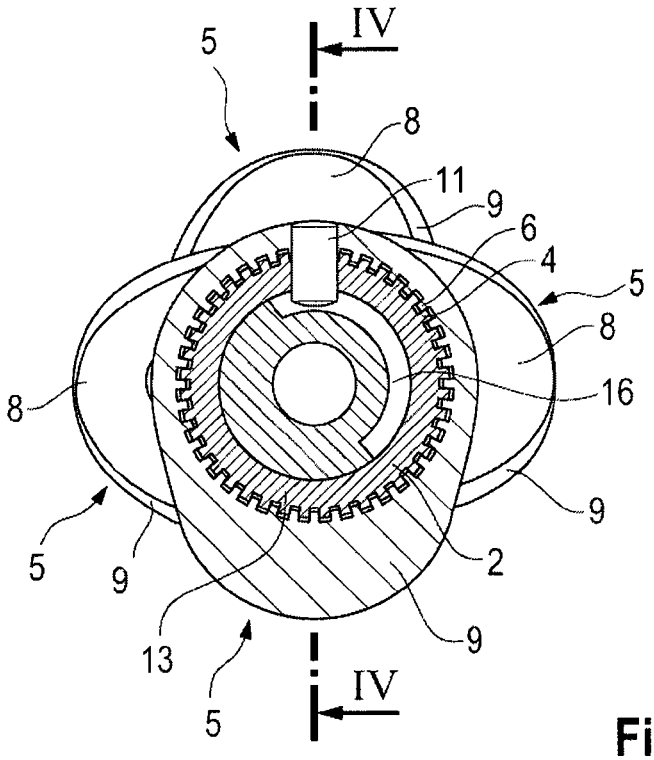
Figure 6:
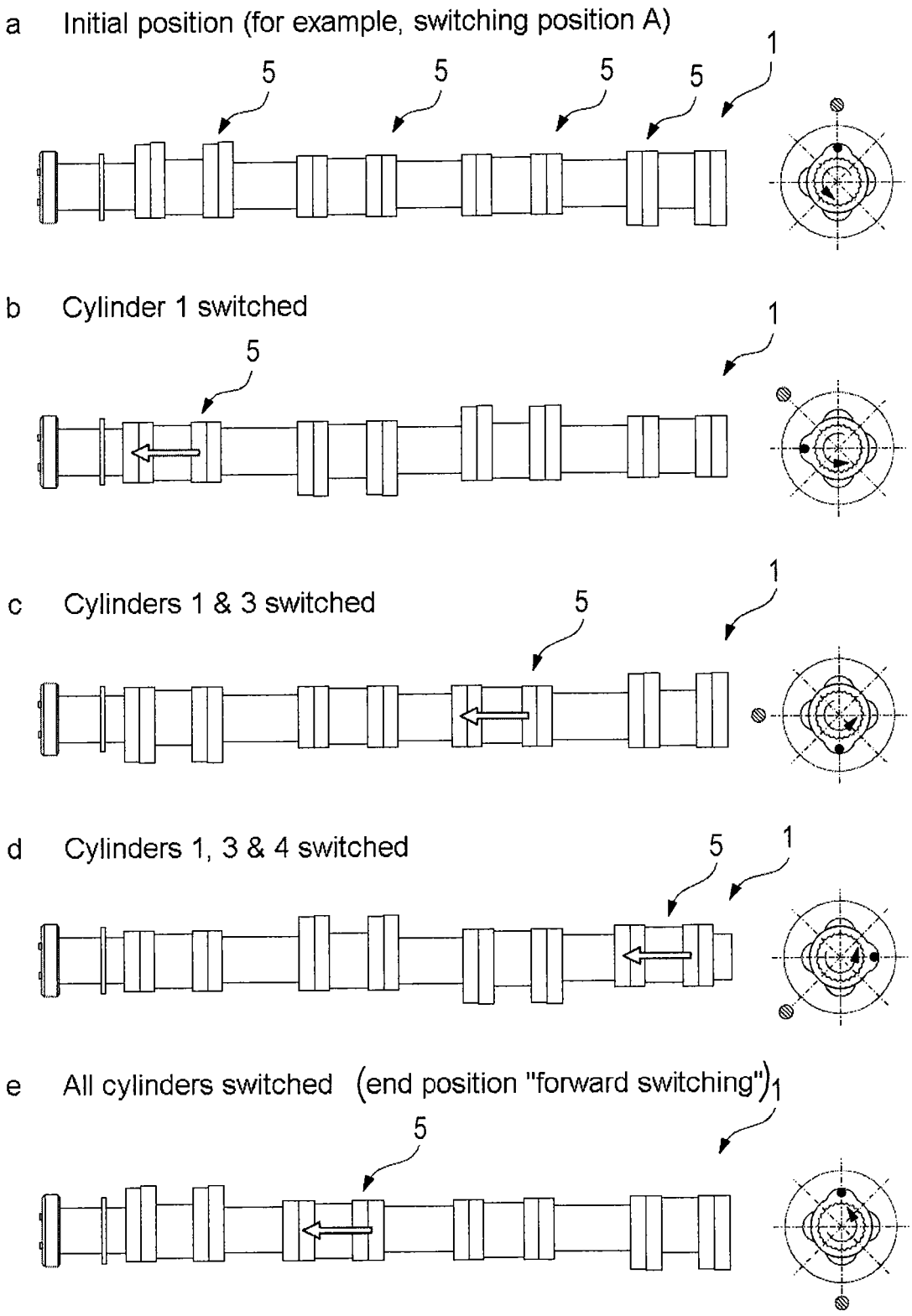
Figure 7:
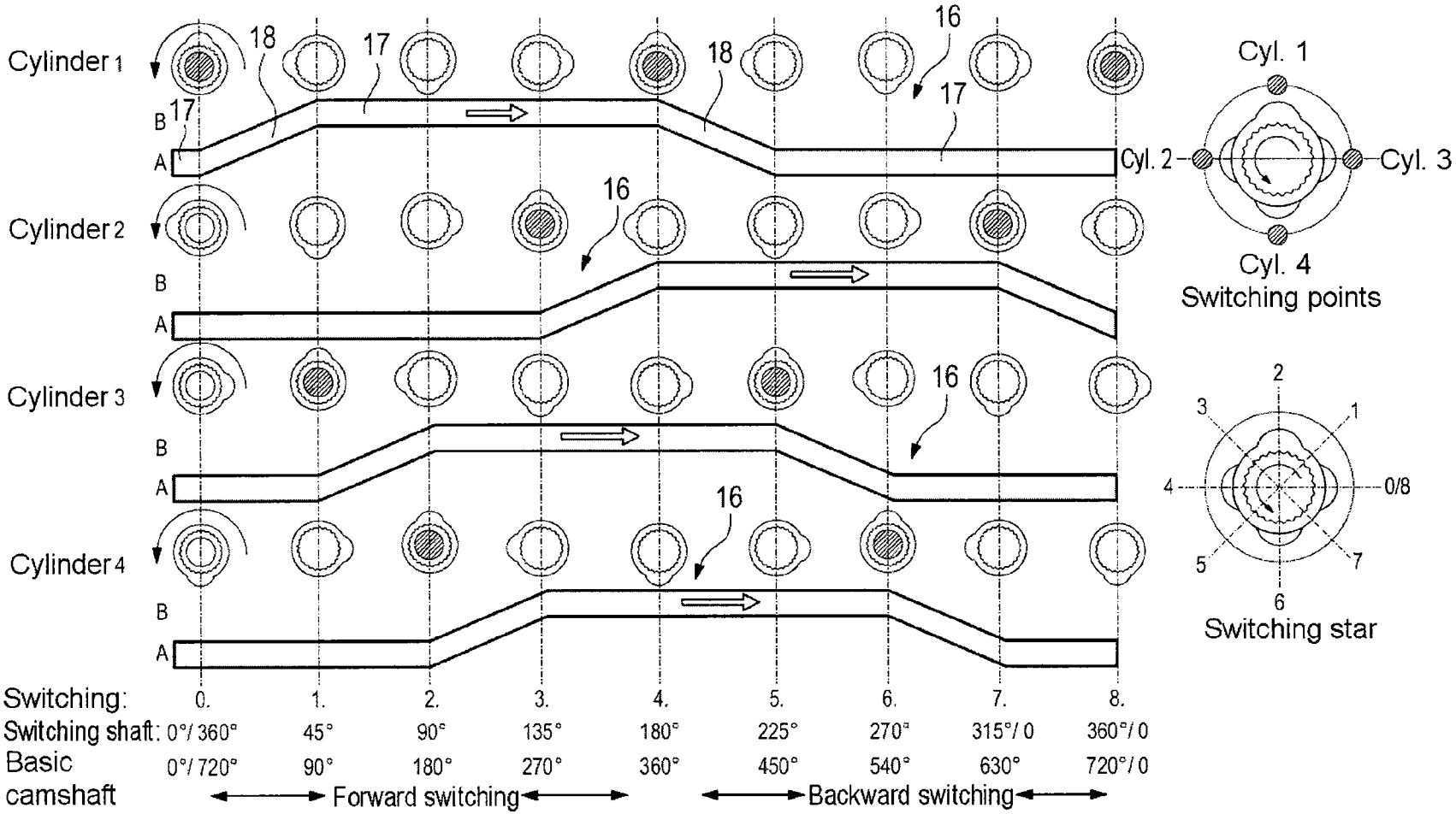

Further features of the invention result from the appended drawing and the description of the preferred exemplary embodiment illustrated in the drawing, without being restricted thereto. In the drawing:

FIG. 1 shows a three-dimensional illustration of the camshaft according to aspects of the invention, FIG. 2 shows a three-dimensional view of the components which form the illustrated camshaft, FIG. 3 shows a longitudinal section of the camshaft, illustrated via a part region of the camshaft, FIG. 4 shows a section through the camshaft according to the line IV-IV in FIG. 5, FIG. 5 shows a section through the camshaft according to the line V-V in FIG. 4, FIG. 6 shows the camshaft, illustrated for various switching positions of the sliding pieces of the camshaft in the case of a four-cylinder inline engine, and FIG. 7 shows a switching diagram in the cylinder of a four-cylinder inline engine for the ignition sequence cylinder 1-cylinder 3-cylinder 4-cylinder 2.

DETAILED DESCRIPTION OF THE DRAWING FIGURES

The following description relates first of all to the illustration of FIGS. 1 to 5, in particular to the illustration of FIG. 2:

A camshaft 1 is shown for an internal combustion engine which is configured as a four-cylinder inline engine. The camshaft 1 serves to control the movement of inlet valves, each cylinder of the internal combustion engine having two inlet valves. Instead, the camshaft can by all means also be provided for controlling the outlet valves of the internal combustion engine.

The camshaft 1 has a basic camshaft 2 with a camshaft drive 3 in the region of one end of the basic camshaft 2. The camshaft drive 3 is driven by means of a chain or a belt which surrounds the crankshaft of the internal combustion engine, the basic camshaft 2 rotating at half the crankshaft rotational speed while the engine is running. In accordance with the arrangement of the four cylinders of the internal combustion engine, the basic camshaft 2 has, for example, four spline tooth systems 4 which are arranged at a spacing from one another in the longitudinal direction of the basic camshaft 2. Said spline tooth systems 4 on the external diameter serve to receive sliding pieces 5, therefore four sliding pieces 5, which have a spline tooth system 6 on the internal diameter. Each of the sliding pieces 5 is of identical configuration and in each case has two cam packs 7, the respective cam pack being configured as a cam pair. The respective cam pair therefore has two cams 8, 9. The two cams 8, 9 have different cam profiles in relation to their contour and/or their lift. The respective sliding piece 5 has a receiving hole 10 for a slotted-guide pin 11 in the base circle of the cam 8 or 9. In concrete terms, one of the cams 9 of the respective sliding piece 5 is provided with the receiving hole 10, into which the slotted-guide pin 11 is inserted, the slotted-guide pin 11 protruding radially inwardly beyond the spline tooth system 6 of the sliding piece 5. The slotted-guide pin 11 is connected fixedly to the sliding piece 5.

On account of the spline tooth systems 4 and 6, the sliding pieces 5 can be displaced axially on the basic camshaft 2, but cannot rotate relative to the basic camshaft 2. In the region of each of the four external spline tooth systems 4, the basic camshaft 2 is provided with slots 12 which extend in the axial direction of the basic camshaft 2. That slotted-guide pin 11 of the sliding piece 5 which is assigned to the spline tooth system 4 which has the slot 12 penetrates the respective slot 12. Accordingly, the sliding piece 5 can be displaced axially in the longitudinal extent of the basic camshaft 2 relative to the latter in accordance with the longitudinal extent of the slot 12, regardless of the slotted-guide pin 11 which penetrates the slot 12.

The basic camshaft 2 is provided with a coaxial through hole. Substantially over the entire length of the hole, the basic camshaft 2 penetrates a switching shaft 13 with four switch guide plates 14 and an end-side receptacle 15 for an actuator system.

In relation to the longitudinal extent of the switching shaft 13, the switch guide plates 14 are arranged at a spacing from one another. Each switch guide plate has an endless slotted-guide track 16 which therefore extends over a complete circle. The four slotted-guide pins 11 which are connected to the four sliding pieces 5 engage into the four slotted-guide tracks 16 of the four switch guide plates 14. If a rotational movement is introduced into the switching shaft 13 via the actuator system and therefore the receptacle of the switching shaft 13, this leads to a situation where, on account of the positively locking connection between the switch guide plates 14 and the slotted-guide pins 11, the sliding pieces 5 are moved to and fro in the axial direction of the camshaft 1, in the case of a rotation of the switching shaft 13 in the same rotational direction, and are therefore moved in the sense of switching to and fro of the sliding pieces 5 and therefore of the cams 8 and 9. Here, the slotted-guide pins 11 which are connected fixedly to the sliding pieces 5 slide in the slotted-guide tracks 16 of the switch guide plates 14.

In the following text, in particular using FIGS. 6 and 7, the method of operation of the camshaft according to aspects of the invention in the four-cylinder inline engine will be described, with a switching diagram for an ignition sequence cylinder 1-cylinder 3-cylinder 4-cylinder 2 of the cylinders of the internal combustion engine.

While the engine is running, the basic camshaft 2 with the sliding pieces 5 situated on it and the switching shaft 13 lying on the inside rotates at half the crankshaft rotational speed. The sliding pieces 5 are situated, for example, in the switching position A. Relative to the rotational movement of the basic camshaft 2, the shifting shaft 13 is situated at the rest point outside of the switching operation. As a result of a pulse which is triggered by the engine controller, the actuator system rotates the switching shaft 13 via the receptacle 15 during the base circle phase, in the rotational direction or counter to the rotational direction of the basic camshaft 2, by a defined angle and therefore triggers the switching operation for "cylinder 1". As a result of the rotation of the switching shaft 13 and the design and arrangement of the circulating slotted-guide track 16 of the switch guide plate 14, the rotational movement is converted into an axial movement which displaces the sliding piece 5 for "cylinder 1" from position A, to which the first cam profile, thus for example of the cams 8, corresponds, to position B, to which the second cam profile, in this case then of the cams 9, corresponds. The switching takes place in the base circle of the cams. This operation is repeated three times, with the result that, at the end of four of the rotational movements of the switching shaft 13, all the sliding pieces 5 have been pushed from position A to position B. The design and arrangement of the switch guide plates 14 with the slotted-guide tracks 16 for "cylinders 1-4" allows the cylinders to be displaced individually in the ignition sequence from position A to position B. The displacement path is fixed solely by the design of the slotted-guide tracks 16. The switching back of the cylinders (in the ignition sequence) takes place according to the above-described diagram. The switching shaft 13 is rotated further four times in or counter to the clockwise direction, with the result that the sliding pieces 5 are again pushed back into their initial position individually and in the ignition sequence. If the four rotations of the switching shaft 13 are carried out during the switching-back operation, the sliding pieces 5 and the switching shaft 13 are situated in their initial position (switching position A) again.

These different switching positions are illustrated in greater detail in FIG. 6 and will be explained as follows with regard to the states a. to e. shown in this figure:

In addition to diagrams a. to e., FIG. 6 illustrates the position of the switching shaft by way of a dot and the position of the basic camshaft with sliding pieces by way of the circle.

a. Initial Position (for Example, Switching Position A)

The basic camshaft 2 and the switching shaft 13 are situated in the initial position. The basic camshaft position with cylinder 1 is at the "12 o'clock position"—0°/360°. All the sliding pieces are at switching position A.

b. Cylinder 1 Switched

The shifting shaft is rotated by 45° counter to the clockwise direction. The basic camshaft position with cylinder 1 is at the "9 o'clock position"—90°. The sliding piece for cylinder 1 is at switching position B, and the sliding pieces for the cylinders 2 to 4 are at switching position A.

c. Cylinders 1 and 3 Switched

The switching shaft is rotated by 90° counter to the clockwise direction. The basic camshaft position with cylinder 1 is situated at the "6 o'clock position"—180°. The sliding pieces for the cylinders 1 and 3 are situated at switching position B, and the sliding pieces for the cylinders 2 and 4 are situated at switching position A.

d. Cylinders 1, 3 and 4 Switched

The switching shaft is rotated by 135° counter to the clockwise direction. The basic camshaft position with cylinder 1 is situated at the "3 o'clock position"—270°. The sliding pieces for the cylinders 1, 3 and 4 are situated at switching position B, and the sliding piece for the cylinder 2 is situated at switching position A.

e. All Cylinders Switched (End Position "Forward Switching")

The switching shaft is rotated by 180° counter to the clockwise direction. The basic camshaft position with cylinder 1 is at the "12 o'clock position"-360°/0°. All the sliding pieces are at switching position B. The switching shaft and basic camshaft are at the end position "forward switching".

In the switching diagram illustrated in FIG. 7 for the ignition sequence 1-3-4-2, the slotted-guide tracks 16 of the four switch guide plates 14 are shown in a developed view for the individual cylinders, in order to show the different times of the forward switching and backward switching of the cams 8 and 9 of the cam pack which is assigned to the respective cylinder. It can be gathered from this figure that the respective slotted-guide track 16 has two substantially parallel first slotted-guide sections 17 and two second slotted-guide sections 18 which connect said slotted-guide sections 17 and bring about the switching. The first slotted-guide sections 17 are positioned substantially in planes which are arranged perpendicularly with respect to the rotational axis of the switching shaft 13. One second slotted-guide section 18 is assigned to a relative rotary angle range of the switching shaft of from 0° to 45° and the other second slotted-guide section 18 is assigned to a relative rotary angle range of the switching shaft 13 of from 180° to 225°. It can be gathered from the illustration of FIG. 7 that these relative rotary angle ranges are displaced from cylinder to cylinder, in relation to the orientation of a clock, in order to bring about the desired ignition sequences.

Accordingly, this design of the camshaft makes switching to and fro possible by way of the same slotted guide. The configuration of the slotted-guide track makes cylinder-selective switching in the ignition sequence possible. During the switch operation, the switching shaft is rotated only in one direction (relative to the basic camshaft). Endless switching is possible as a result of the design of the slotted guide. The switching shaft is therefore always rotated in one direction, the switching direction, independently of whether switching to or fro is to take place. The starting and end points of the switching, in relation to the position of the basic camshaft, can vary depending on the configuration of the slotted guide.

LIST OF REFERENCE NUMBERS

1 Camshaft
2 Basic camshaft
3 Camshaft drive
4 Spline tooth system
5 Sliding piece
6 Spline tooth system
7 Cam pack
8 Cam
9 Cam
10 Receiving hole
11 Slotted-guide pin
12 Slot
13 Switching shaft
14 Switch guide plate
15 Receptacle/actuator system
16 Slotted-guide track
17 Slotted-guide section
18 Slotted-guide section

What is claimed:

1. A camshaft assembly having a rotationally drivable basic camshaft and at least one sliding piece which is mounted on the basic camshaft and is configured to be displaced in a longitudinal direction of the basic camshaft, the at least one sliding piece having at least one cam pack with at least two cams with different cam profiles, and having a switching device which has a switch guide plate for displacing the at least one sliding piece into different switching positions of the cams, wherein the switching device has a switching shaft arranged within the basic camshaft which is configured to be rotated about a rotational axis of the basic camshaft with a switch guide plate which has a slotted-guide track, and a slotted-guide pin which is connected to the at least one sliding piece and engages into the slotted-guide track, the slotted-guide track being endless and switching to and fro of the sliding piece taking place in the same rotational direction of the switching shaft.

2. The camshaft assembly as claimed in claim 1, wherein the basic camshaft has an opening in its wall, which opening the slotted-guide pin penetrates.

3. A camshaft assembly having a rotationally drivable basic camshaft and at least one sliding piece which is mounted in the basic camshaft and is configured to be displaced in a longitudinal direction of the basic camshaft, the at least one sliding piece having at least one cam pack with at least two cams with different cam profiles, and having a switching device which has a switch guide plate for displacing the at least one sliding piece into different switching positions of the cams, wherein the switching device has a switching shaft which is configured to be rotated about a rotational axis of the basic camshaft with a switch guide plate which has a slotted-guide track, and a slotted-guide pin which is connected to the at least one sliding piece and engages into the slotted-guide track, the switching shaft being arranged within the basic camshaft, and the basic camshaft having an opening in its wall, which opening the slotted-guide pin penetrates.

4. The camshaft assembly as claimed in claim 3, wherein the slotted-guide track is endless and switching to and fro of the sliding piece takes place in the same rotational direction of the switching shaft.

5. The camshaft assembly as claimed in claim 3, wherein the opening is formed as a slot which extends in an axial direction of the basic camshaft.

6. The camshaft assembly as claimed in claim 3, wherein the camshaft assembly has one sliding piece for each cylinder of an internal combustion engine which is assigned to said camshaft assembly.

7. The camshaft assembly as claimed in claim 6, wherein each sliding piece has two cam packs.

8. The camshaft assembly as claimed in claim 7, wherein each cam pack has a cam pair, the two cams of which have different cam profiles, or each cam pack has more than two cams which have different profiles.

9. The camshaft assembly as claimed in claim 7, wherein the cams of each cam pack have different cam profiles in relation to their contour and/or lift.

10. The camshaft assembly as claimed in claim 3, wherein the basic camshaft has a spline tooth system on its external diameter in a region of each sliding piece, and each sliding piece has a corresponding spline tooth system on its internal diameter.

11. The camshaft assembly as claimed in claim 3, wherein the switching shaft has an end-side receptacle for an actuating unit for rotating the switching shaft.

12. The camshaft assembly as claimed in claim 3, wherein the slotted-guide track has two substantially parallel first slotted-guide sections which are positioned in planes which are arranged substantially perpendicularly with respect to a rotational axis of the switching shaft, and two second slotted-guide sections which connect said slotted-guide sections and bring about the switching.

13. The camshaft assembly as claimed in claim 12, wherein one second slotted-guide section is assigned to a relative rotary angle range of the switching shaft of from 0° to 45° and the other second slotted-guide section is assigned to a relative rotary angle range of the switching shaft of from 180° to 225°.

14. The camshaft assembly as claimed in claim 3, wherein, in a camshaft for a four-cylinder inline engine having four switch guide plates and four sliding pieces, the slotted-guide tracks of the switch guide plates of the sliding pieces are arranged in a relatively rotated manner with regard to the switching shaft, such that a displacement of the four sliding pieces takes place in an ignition sequence cylinder 1-cylinder 3-cylinder 4-cylinder 2.

* * * * *